US008997804B2

(12) United States Patent
Grantham et al.

(10) Patent No.: US 8,997,804 B2
(45) Date of Patent: Apr. 7, 2015

(54) NOZZLE INTERLOCK FAILSAFE/LOST MOTION MECHANISMS

(75) Inventors: Rodger P. Grantham, Springfield, MO (US); Christopher S. Spencer, Oregonia, OH (US)

(73) Assignee: Vapor Systems Technologies, Inc., Springboro, OH (US)

( * ) Notice: Subject to any disclaimer, the term of this patent is extended or adjusted under 35 U.S.C. 154(b) by 797 days.

(21) Appl. No.: 13/275,461

(22) Filed: Oct. 18, 2011

(65) Prior Publication Data

US 2013/0092761 A1 Apr. 18, 2013

(51) Int. Cl.

| | |
|---|---|
| ***B65B 1/04*** | (2006.01) |
| ***B67D 7/54*** | (2010.01) |
| *B67C 3/26* | (2006.01) |

(52) U.S. Cl.
CPC .. *B67D 7/54* (2013.01); *B67C 3/264* (2013.01)

(58) Field of Classification Search
CPC ..... B67D 7/06; B67D 7/44; B67D 7/54; B67D 2007/545; B67C 3/264
USPC ..... 141/351, 352, 353, 355, 206
See application file for complete search history.

(56) References Cited

U.S. PATENT DOCUMENTS

| | | | | |
|---|---|---|---|---|
| 2,271,151 | A | | 1/1942 | Fina et al. |
| 2,354,209 | A | | 7/1944 | Hammand |
| 3,502,121 | A | | 3/1970 | Moore et al. |
| 3,548,893 | A | | 12/1970 | Moore |
| 3,590,890 | A | | 7/1971 | Young |
| 3,719,215 | A | | 3/1973 | Murray |
| 3,881,528 | A | | 5/1975 | Mackenzie |
| 3,974,865 | A | * | 8/1976 | Fenton et al. ..... 141/311 R |
| 3,982,571 | A | | 9/1976 | Fenton et al. |
| 4,023,601 | A | | 5/1977 | Hansel |
| 4,033,389 | A | | 7/1977 | Hansel et al. |
| 4,058,149 | A | | 11/1977 | Hansel |
| 4,059,135 | A | | 11/1977 | Hansel |
| 4,060,110 | A | * | 11/1977 | Bower ..... 141/207 |
| 4,062,384 | A | | 12/1977 | Frahm et al. |
| 4,121,635 | A | | 10/1978 | Hansel |
| 4,213,488 | A | * | 7/1980 | Pyle ..... 141/1 |
| 5,121,777 | A | | 6/1992 | Leininger et al. |
| 5,224,524 | A | * | 7/1993 | Nijsen ..... 141/98 |
| 5,655,576 | A | | 8/1997 | Leininger et al. |
| 6,851,628 | B1 | | 2/2005 | Garrison et al. |
| 7,000,657 | B1 | | 2/2006 | Thorpe et al. |
| 7,040,358 | B2 | | 5/2006 | Lacroix et al. |
| 7,134,580 | B2 | | 11/2006 | Garrison et al. |
| 7,406,988 | B2 | | 8/2008 | Mitchell |
| 7,987,878 | B1 | * | 8/2011 | Imler ..... 141/59 |

* cited by examiner

*Primary Examiner* — Jason K Niesz
(74) *Attorney, Agent, or Firm* — Stevens & Showalter, LLP

(57) ABSTRACT

The present invention comprises a nozzle assembly for dispensing fuel into an inlet of a container comprising a body, a spout and a vapor collection sleeve fitted over the spout and compressing when the spout is inserted into the inlet of a container. An interlock mechanism prevents operation of the nozzle assembly unless the sleeve is at least partially compressed by insertion of the spout into the container inlet. The interlock mechanism includes structure to prevent the interlock mechanism from moving from the engaged position to the disengaged position in the event of a failure of the interlock mechanism whereby the nozzle assembly cannot dispense fuel regardless of whether the spout is engaged with the inlet of the container or not. An interlock actuator is mounted for movement within the body and coupled to the sleeve, while a lost motion mechanism limits movement of the interlock actuator into the body.

29 Claims, 11 Drawing Sheets

NOZZLE INTERLOCK FAILSAFE/LOST MOTION MECHANISMS

FIELD OF THE INVENTION

The present invention relates in general to nozzles for dispensing fuel and, more particularly, to a fuel nozzle fail-safe mechanism and lost motion mechanisms for a fuel nozzle assembly.

BACKGROUND OF THE INVENTION

An EVR (Enhanced Vapor Recovery) fuel nozzle supplies gasoline, diesel or another type of fuel into a container through an inlet in the container. The container is typically a vehicle fuel tank and the inlet may comprise a fill neck of a variety of lengths protruding away from the container. Fuel nozzles may include an interlock mechanism to prevent fuel from being dispensed until a spout of the nozzle is inserted into a fuel container inlet. When the spout of such a fuel nozzle is placed inside the fill neck of a vehicle fuel tank, the interlock mechanism is disengaged so that a pivotally mounted nozzle control lever is enabled to dispense fuel when squeezed. When the lever is enabled to dispense fuel, it can be referred to as being in a "live lever" state. After fuel has been dispensed and the nozzle is removed from the fill neck, the interlock reengages to disable the lever so that fuel can no longer be dispensed from the nozzle even if the lever is squeezed. When the lever is disabled, it can be referred to as being in a "dead lever" state

SUMMARY OF THE INVENTION

When a spout of a nozzle including the interlock of the present application is inserted into an inlet of a fuel tank, the interlock mechanism is moved from an interlock enabled position (nozzle dead lever state) to an interlock disabled position (nozzle live lever state). Accordingly, the nozzle cannot dispense fuel if removed from the tank inlet. If an interlock mechanism fails in the interlock disengaged position, the nozzle can continue to dispense fuel whether the nozzle spout in inserted into a fuel inlet or not. In accordance with the teachings of the present application, a fuel nozzle interlock mechanism fails safe in the interlock enabled position (nozzle dead lever state) so that the fuel nozzle in which the interlock is installed cannot dispense fuel. By failing safe, i.e., in its enabled position, the interlock mechanism ensures that fuel cannot be dispensed whether or not the nozzle spout is inserted into an inlet of a fuel container. Since the nozzle is entirely disabled, the fail safe interlock mechanism of the present application ensures that the nozzle cannot be improperly used and that it will be repaired or replaced upon failure of the interlock mechanism.

In accordance with further teachings of the present application, a lost motion mechanism limits movement of the interlock between the interlock engaged position and the interlock disengaged position. The lost motion mechanism substantially limits movement of the interlock mechanism beyond its disengaged position when the spout of the nozzle is inserted into a long inlet of a fuel container to prevent over-travel of the interlock mechanism which may accelerate wear and failure of the interlock mechanism.

In accordance with one aspect of the present invention, a nozzle assembly for dispensing fuel into an inlet of a container comprises a body having a passage for fuel flow through the body and a spout attachable to the body for passing fuel from the body, through the spout, and into an inlet of a container. A sleeve fitted over the spout, which may be used for vapor collection from the container, compresses when the spout is inserted into the inlet of the container and expands from compression when the spout is removed from the inlet of the container. An interlock mechanism within the body prevents operation of the nozzle assembly unless the sleeve is at least partially compressed. An interlock actuator is mounted for movement within the body and is coupled to the sleeve. The interlock mechanism moves from an engaged position to a disengaged position as the interlock actuator moves into the body upon compression of the sleeve and moves from the disengaged position to the engaged position as the interlock mechanism moves out of the body upon the sleeve expanding from compression. The interlock mechanism includes structure to prevent the interlock mechanism from moving from the engaged position to the disengaged position in the event of a failure of the interlock mechanism whereby the nozzle assembly cannot dispense fuel regardless of whether the spout is engaged with the inlet of the container or not.

The interlock actuator may further comprise a lost motion mechanism to limit movement of the interlock actuator into the body. The interlock actuator may comprise an interlock rod, and the lost motion mechanism may comprise at least one spring biasing the interlock rod. The lost motion mechanism may be incorporated into the interlock rod by having the rod comprise a tubular member having a shouldered opening at a first end and a second end. A shouldered push pin is received within the tubular member and has a first end movably passing through the shouldered opening at the first end of the tubular member and a second end having a diameter larger than the first end to define a shoulder that engages a shoulder of the shouldered opening of the tubular member to limit extension of the first end of the push pin from the tubular member. At least one compression spring is fitted within the tubular member and engages the second end of the push pin. A retainer is secured into the second end of the tubular member for retaining the at least one compression spring between the retainer and the second end of the push pin. The at least one spring may comprise first and second springs. As the interlock mechanism moves from the engaged position to the disengaged position, a first biasing force increases to a second biasing force. The push pin compresses the at least one compression spring at the second biasing force to limit movement of the push pin into the body upon compression of the sleeve beyond a point of compression required to disengage the interlock mechanism.

The interlock mechanism may comprise at least one resilient member providing the first biasing force when the interlock mechanism is in the engaged position and providing the second biasing force when the interlock mechanism is in the disengaged position. The lost motion mechanism may alternately comprise a first element movably coupled to the spout and supporting the interlock actuator, a resilient actuator member positioned between the first element and the body, a second element movably coupled to the spout and coupled to the sleeve, and a lost motion resilient member positioned between the first and second elements. The at least one resilient member may comprise at least one extension spring, and the resilient actuator member and the lost motion resilient member may each comprise at least one compression spring.

The interlock mechanism may comprise an interlock assembly housing, a slide movable within the interlock assembly housing, the slide having a first end engaged by the interlock actuator and a second end, first and second resilient members configured to bias the slide into the interlock engaged position, and a slide retaining member coupled to the second end of the slide and engaging the first and second resilient members. The slide retaining member prevents movement of the slide into the interlock disengaged position upon failure of one of the first and second resilient members. To that end, the slide retaining member may comprise a third resilient member having first and second arms for engaging the first and second resilient members, one of the first and second arms moving to a position blocking movement of the slide within the interlock assembly housing upon failure of one of the first and second resilient members. The third resilient member may comprise a spring including the first and second arms which are biased away from the slide movement blocking position by the first and second resilient members.

The slide retaining member alternately may comprise an end block having first and second extensions on either side wherein the first and second extensions are coupled to the first and second resilient members such that the slide is disposed between the first and second resilient members. The interlock assembly housing then includes openings wherein one of the first and second end block extensions engages one of the interlock housing openings to prevent movement of the slide into the interlock disengaged position in the event of failure of one of the first and second resilient members. The end block may comprise a substantially flat side distal from the slide, and the first and second end block extensions may be disposed on and extend from the substantially flat side. Alternately, the end block may comprise a curved side distal from the slide, the curved side may have a diameter substantially equal to an interlock assembly housing inner diameter, and the first and second end block extensions may be disposed on and extend from the curved side of the end block.

In accordance with another aspect of the present invention, a nozzle assembly for dispensing fuel into an inlet of a container comprises a body having a passage for fuel flow through the body, a spout attachable to the body for passing fuel from the body, through the spout, and into an inlet of a container, and a sleeve fitted over the spout, which may be used for vapor collection from the container, the sleeve compressing when the spout is inserted into the inlet of the container and expanding from compression when the spout is removed from the inlet of the container. An interlock mechanism within the body prevents operation of the nozzle assembly unless the sleeve is at least partially compressed. An interlock actuator is mounted for movement within the body and is coupled to the sleeve, the interlock mechanism moving from an engaged position to a disengaged position as the interlock actuator moves into the body upon compression of the sleeve and moving from the disengaged position to the engaged position as the interlock mechanism moves out of the body upon the sleeve expanding from compression wherein the interlock actuator comprises a lost motion mechanism to limit movement of the interlock actuator into the body.

The interlock actuator may comprise an interlock rod and the lost motion mechanism may comprise at least one spring biasing the interlock rod. The lost motion mechanism may be incorporated into the interlock rod by having the rod comprise a tubular member having a shouldered opening at a first end and a second end. A shouldered push pin is received within the tubular body and has a first end movably passing through the opening at the shouldered end of the tubular body and a second end having a diameter larger than the first end to define a shoulder that engages a shoulder of the shouldered opening of the tubular member to limit extension of the first end of the push pin from the tubular member. At least one compression spring is fitted within the tubular member and engages the second end of the push pin. A retainer is secured into the second end of the tubular member for retaining the at least one compression spring between the retainer and the second end of the push pin. The at least one spring may comprise first and second springs. The interlock mechanism may be biased to an engaged position by a first biasing force that increases to a second biasing force as the interlock mechanism moves from the engaged position to the disengaged position. The push pin compresses the at least one compression spring at the second biasing force to limit movement of the push pin into the body upon compression of the sleeve beyond a point of compression required to disengage the interlock mechanism.

The interlock mechanism may comprise at least one resilient member providing the first biasing force when the interlock mechanism is in the engaged position and providing the second biasing force when the interlock mechanism is in the disengaged position. The lost motion mechanism alternately may comprise a first element movably coupled to the spout and supporting the interlock actuator, a resilient actuator member positioned between the first element and the body, a second element movably coupled to the spout and coupled to the sleeve, and a lost motion resilient member positioned between the first and second elements. The at least one resilient member may comprise at least one extension spring, and the resilient actuator member and the lost motion resilient member may each comprise at least one compression spring.

The interlock mechanism may include structure to prevent movement of the interlock mechanism from the engaged position to the disengaged position in the event of a failure of the interlock mechanism whereby the nozzle assembly cannot dispense fuel regardless of whether the sleeve is compressed due to the spout being engaged with the inlet of the container or not. The interlock mechanism may comprise an interlock assembly housing, a slide movable within the interlock assembly housing, the slide having a first end engaged by the interlock actuator and a second end, first and second resilient members configured to bias the slide into the interlock engaged position, and a slide retaining member coupled to the second end of the slide and engaging the first and second resilient members, the slide retaining member preventing movement of the slide into the interlock disengaged position upon failure of one of the first and second resilient members.

The slide retaining member may comprise a third resilient member having first and second arms for engaging the first and second resilient members, one of the first and second arms moving to a position blocking movement of the slide within the interlock assembly housing upon failure of one of the first and second resilient members. The third resilient member may comprise a spring including the first and second arms which are biased away from the slide movement blocking position by the first and second resilient members.

The slide retaining member may alternately comprise an end block having first and second extensions on either side. The first and second extensions may be coupled to the first and second resilient members such that the slide is disposed between the first and second resilient members. The interlock assembly housing may include openings and one of the first and second end block extensions engages one of the interlock housing openings to prevent movement of the slide into the interlock disengaged position in the event of failure of one of the first and second resilient members. The end block may comprise one of a substantially flat side and a curved side distal from the slide wherein the first and second end block extensions are disposed on and extend from the one of a substantially flat side and curved side.

BRIEF DESCRIPTION OF THE DRAWINGS

While the specification concludes with claims particularly pointing out and distinctly claiming the present invention, it is believed that the present invention will be better understood from the following description in conjunction with the accompanying drawing figures, in which like reference numerals identify like elements, and wherein:

DETAILED DESCRIPTION OF THE INVENTION

Figure 1A:
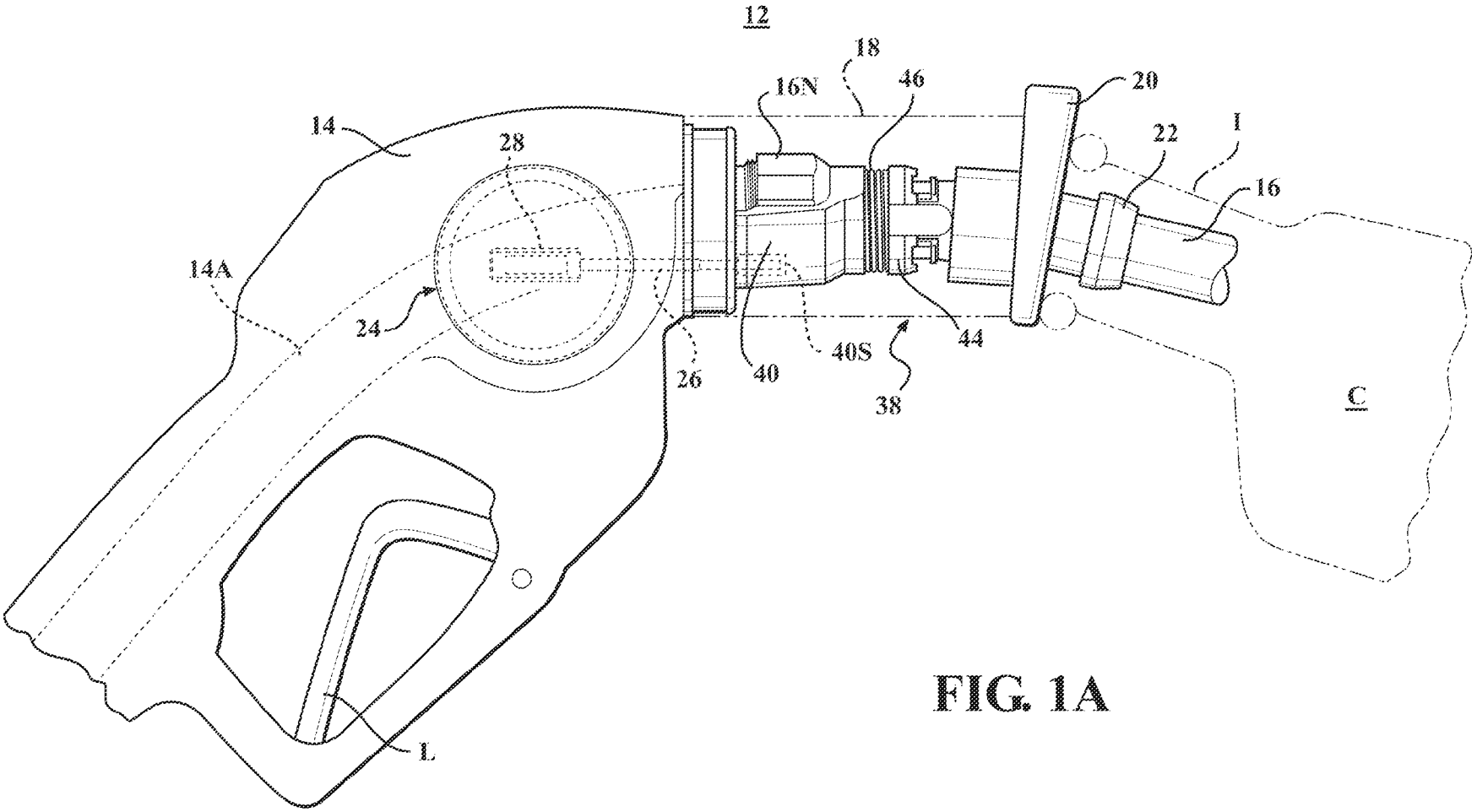
FIGS. 1A and 1B are partial schematic side views of nozzle assemblies illustrating aspects of the teachings of the present application.
Figure 1B:
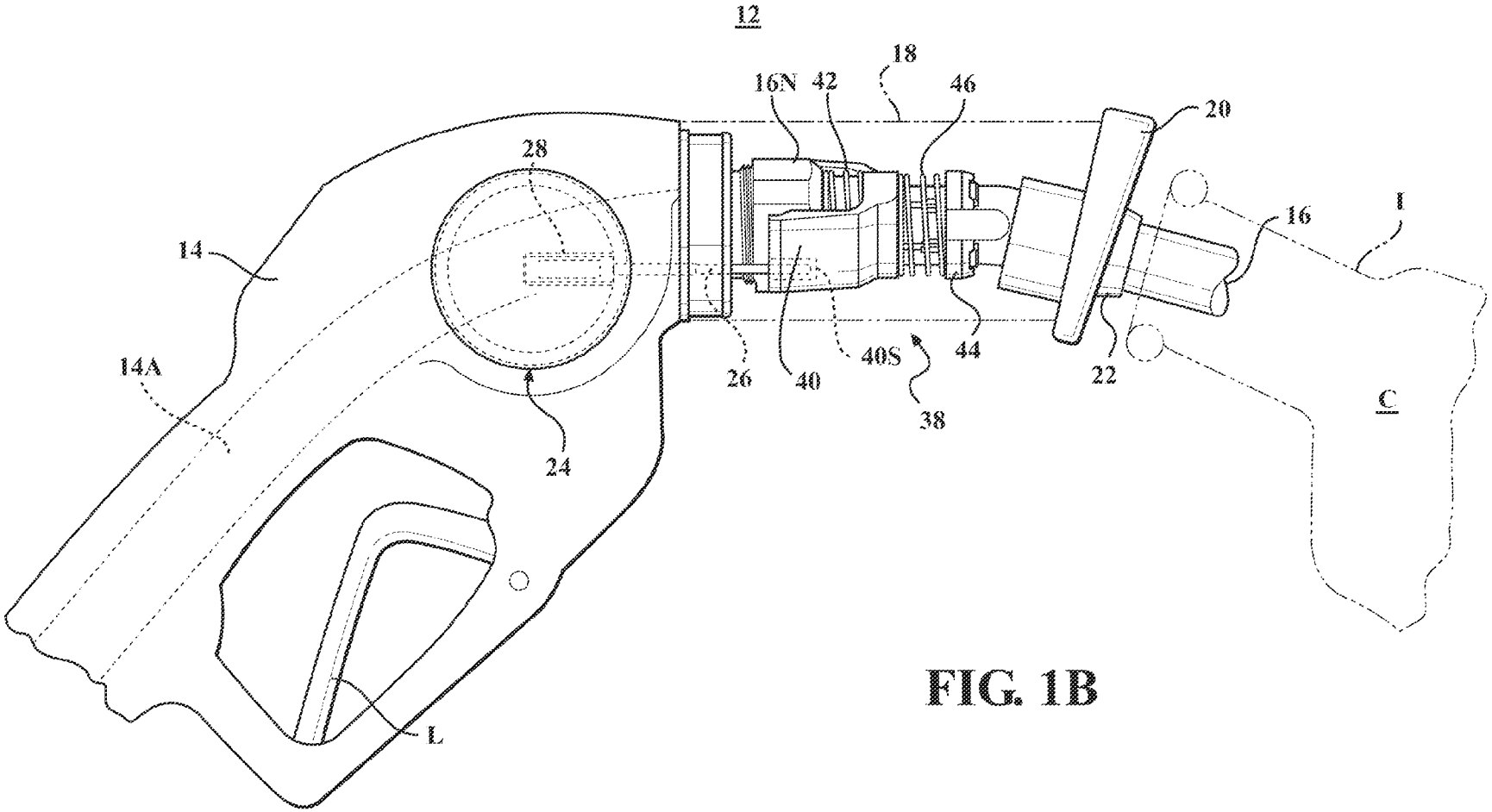

In the following detailed description, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Reference is now made to FIGS. 1A-2B, which schematically illustrate portions of a nozzle assembly 12 for dispensing fuel into an inlet I of a container C according to two embodiments operable in accordance with the teachings of the present application. The fuel nozzle assembly 12 comprises a body 14 having a passage 14A for fuel flow through the body 14 and a spout 16 attachable to the body 14 for passing fuel from the body 14, through the spout 16, and through an inlet I into a container C. In the illustrated embodiments, a vapor collection sleeve 18 fitted over the spout 16 is coupled to a face seal 20 that engages the inlet I of the container C. The sleeve 18 compresses when the spout 16 is inserted into the inlet I of the container C and expands from compression when the spout 16 is removed from the inlet I of the container C. The vapor collection sleeve 18 may comprise a bellows or other appropriately flexible, compressible and resilient structure. A latch ring 22 is rigidly coupled to the spout 16 at some distance from the body 14 and the location of the latch ring 22 defines the end of the sleeve 18 when the sleeve is expanded over the spout 16, see FIGS. 1B and 2B. The container C described in the present application typically comprises a vehicle fuel tank, but may be any container capable of being filled with fuel through a container inlet, a necked inlet in the case of a vehicle fuel tank.

With continued reference to FIGS. 1A-2B, the illustrated nozzle assembly 12 comprises an interlock mechanism 24 within the body 14 for preventing operation of the nozzle assembly 12 unless the sleeve 18 is at least partially compressed. An interlock rod or interlock actuator 26 is mounted for movement within the body 14 and coupled to the sleeve 18. The interlock mechanism 24 moves from an engaged position, shown in FIGS. 1B and 2B, to a disengaged position, shown in FIGS. 1A and 2A, in response to the interlock actuator 26 moving into the body 14 upon compression of the sleeve 18. The interlock mechanism 24 moves from the disengaged position shown in FIGS. 1A and 2A to the engaged position shown in FIGS. 1B and 2B as the interlock actuator 26 moves out of the body 14 as the sleeve 18 decompresses upon removal of the spout 16 from the inlet I of the container C.

Fuel flow through the nozzle assembly 12 is conventionally controlled by a main fuel valve (not shown) which may be opened and closed by an operating lever L shown in FIGS. 1A-2B. To prevent inadvertent fuel dispensing when the spout is outside of an appropriate container, a trip mechanism stem 36 is normally unlatched as shown in FIG. 3A until the sleeve 18 is compressed in sealing engagement with the inlet I of the container C. Alternately, the sleeve may be in sealing engagement with the container C itself or other structure associated with the inlet I or the container C so that the spout is properly positioned to direct fuel into the container C. When the trip mechanism stem 36 is unlatched, the lever is said to be in a "dead lever" state. Operation of the trip mechanism is well known in the art, does not form part of the invention of the present application and so will not be described further herein. For additional information regarding the trip mechanism and its operation, reference can be made, for example, to U.S. Pat. No. 5,655,576 which is incorporated by reference herein.

Reference is now made to FIGS. 1B, 2B and 3A, and FIGS. 2A, 2B, and 3B, which show the interlock mechanism 24 in the interlock engaged position and the interlock disengaged position, respectively. In the illustrated embodiment, as the interlock actuator 26 moves into the body 16, it pushes a slide 28 from the interlock engaged position to the interlock disengaged position, so that a slide detent 30, best shown in FIGS. 3A and 3B, enables a roller carrier 32 to axially align a pair of rollers 34 with the trip mechanism stem 36. Upon alignment of the rollers 34 with the stem 36, a so called "live lever" state occurs whereby the lever rod 36 is able to actuate the main fuel valve (not shown).

Aspects of the present invention relating to the interlock mechanism 24 having structure for preventing the interlock mechanism 24 from moving from the engaged position to the disengaged position in the event of a failure of the interlock mechanism 24 are shown in FIGS. 7-11 and will be described below. The failsafe structure prevents the nozzle assembly 12 from dispensing fuel regardless of whether the spout 16 is inserted into the inlet I of the container C or not.

Figure 4:
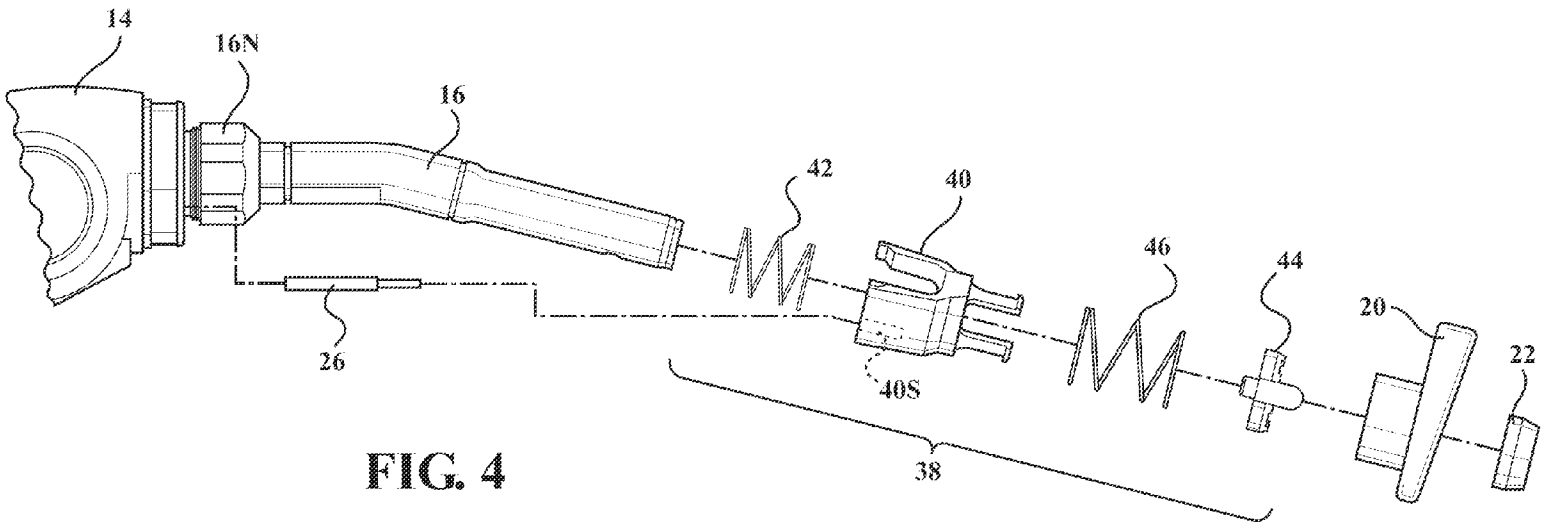
FIG. 4 is an exploded view of a lost motion mechanism in accordance with teachings of the present application.
Figure 4A:
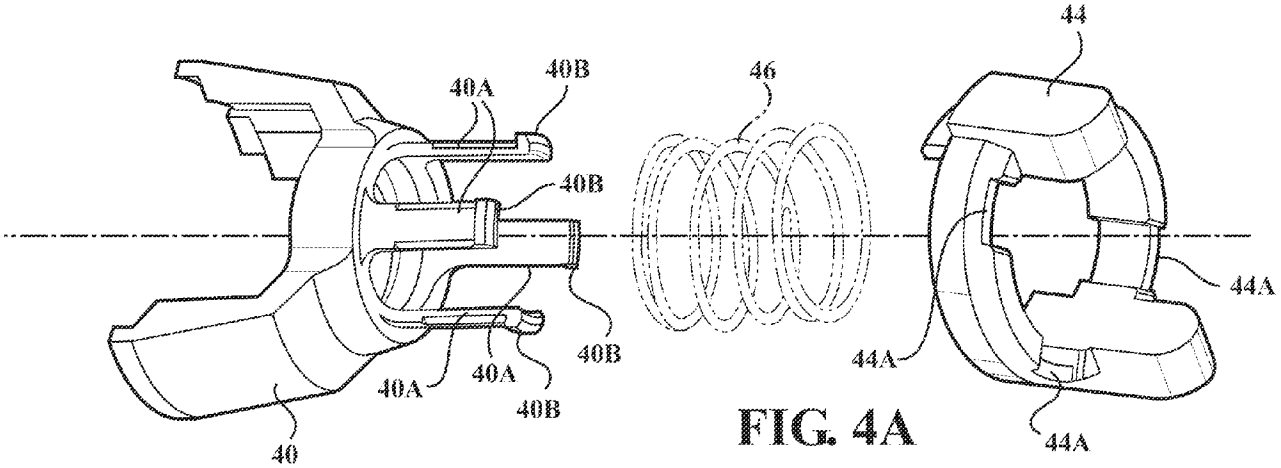
FIG. 4A is a perspective view of the lost motion mechanism of FIG. 4 showing how first and second elements of the mechanism are movably secured to one another to trap a lost motion resilient member therebetween.

Referring now to FIGS. 1A, 1B, 4 and 4A, the illustrated nozzle assembly comprises a first embodiment of a lost motion mechanism 38 to limit movement of the interlock actuator 26 into the body 14. The first lost motion mechanism 38 comprises a first element 40 movably coupled to the spout 16 and supporting the interlock actuator 26. For example, a slot 40S shown in FIGS. 1A, 1B or other appropriate opening may be provided in the first element 40 to receive one end of the interlock actuator 26. As best shown in FIG. 4, a resilient actuator member 42 is positioned between the first element 40 and the body 14 in abutment with a spout nut 16N. A collar forms a second element 44 that is movably coupled to the spout 16 and coupled to the sleeve 18 via the face seal 20. A lost motion resilient member 46 is captured between the first and second elements 40, 44. The first element 40 includes fingers 40A having prongs 40B that are latchingly received within notches 44A of the second element 44 to movably secure the second element 44 to the first element 40, see FIG. 4A. The face seal 20 is movably coupled to the spout 16 and is captured between the second element 44 and the latch ring 22.

Operation of the first embodiment of a lost motion mechanism 38 is controlled by characteristics of the resilient actuator member 42 and the lost motion resilient member 46. More particularly, the resilient actuator member 42 compresses as force is applied to the sleeve 18 which applies force to the first element 40 through the second element 44 and the lost motion resilient member 46. A first biasing force increases to a second biasing force as the resilient actuator member 42 is compressed to the point that the first element 40 engages the spout nut 16N. Forces equal to and greater than the second biasing force cause the lost motion resilient member 46 to be compressed so that movement of the interlock actuator 26 into the body 14 is limited to substantially the movement required to disengage the interlock mechanism 24. Accordingly, the first lost motion mechanism 38 limits movement of the interlock mechanism, the slide 28 in the illustrated embodiment, substantially beyond its disengaged position when the spout 16 of the nozzle assembly 12 is inserted into a long inlet of a fuel container to prevent over-travel of the interlock mechanism which may accelerate wear and failure of the interlock mechanism.

Figure 5:
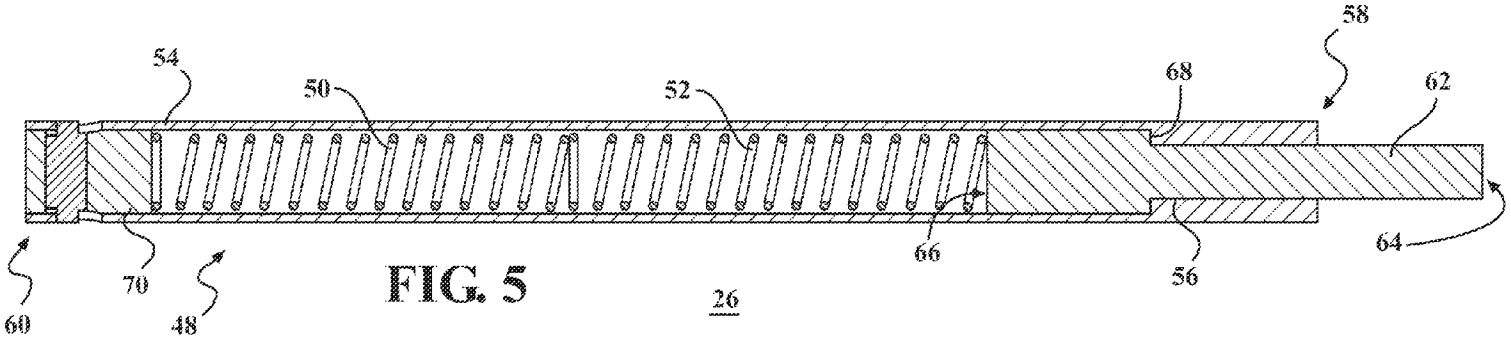
FIG. 5 is a cross sectional view of an interlock rod operable as a lost motion mechanism in accordance with teachings of the present application.

Lost motion also can be affected by applying a spring bias to the interlock rod or interlock actuator 26. One example of spring biasing the interlock actuator 26 for lost motion is illustrated in FIG. 5 where spring biasing is incorporated into the structure of the interlock rod 26 to form a second embodiment of a lost motion mechanism 48. The second embodiment of the lost motion mechanism 48 shown in FIG. 5 comprises first and second springs 50, 52 supported within the interlock actuator 26 which comprises a tubular member 54 having a shouldered opening 56 at a first end 58 and a second end 60.

A shouldered push pin 62 is received within the tubular member 54 and has a first end 64 movably passing through the shouldered opening 56 at the first end 58 of the tubular member. A second end 66 of the push pin 62 has a diameter larger than the first end 64 and defines a shoulder 68 that engages a shoulder of the shouldered opening 56 of the tubular member 54 to limit extension of the first end 64 of the push pin 62 from the tubular member 54. The springs 50, 52 are fitted within the tubular member 54 and engage the second end 66 of the push pin 62. A retainer 70 is secured into the second end 60 of the tubular member 54 for retaining the springs 50, 52 in compression between the retainer 70 and the second end 66 of the push pin 62. The first and second springs 50, 52 define a biasing force (the second biasing force) that results when the interlock mechanism 24 is moved to its disengaged position.

While two springs are illustrated, a single spring or more than two springs could be used as long as the resulting characteristic of the spring or springs is such that the interlock rod or interlock actuator 26 collapses upon application of forces equal to and greater than the second biasing force. Thus the push pin 62 compresses the springs 50, 52 at approximately the second biasing force to limit movement of the push pin 62 into the body 14 upon compression of the sleeve 18 beyond a point of compression required to disengage the interlock mechanism 24 to reduce the possibility of overstressing the interlock mechanism 24.

Figure 2A:
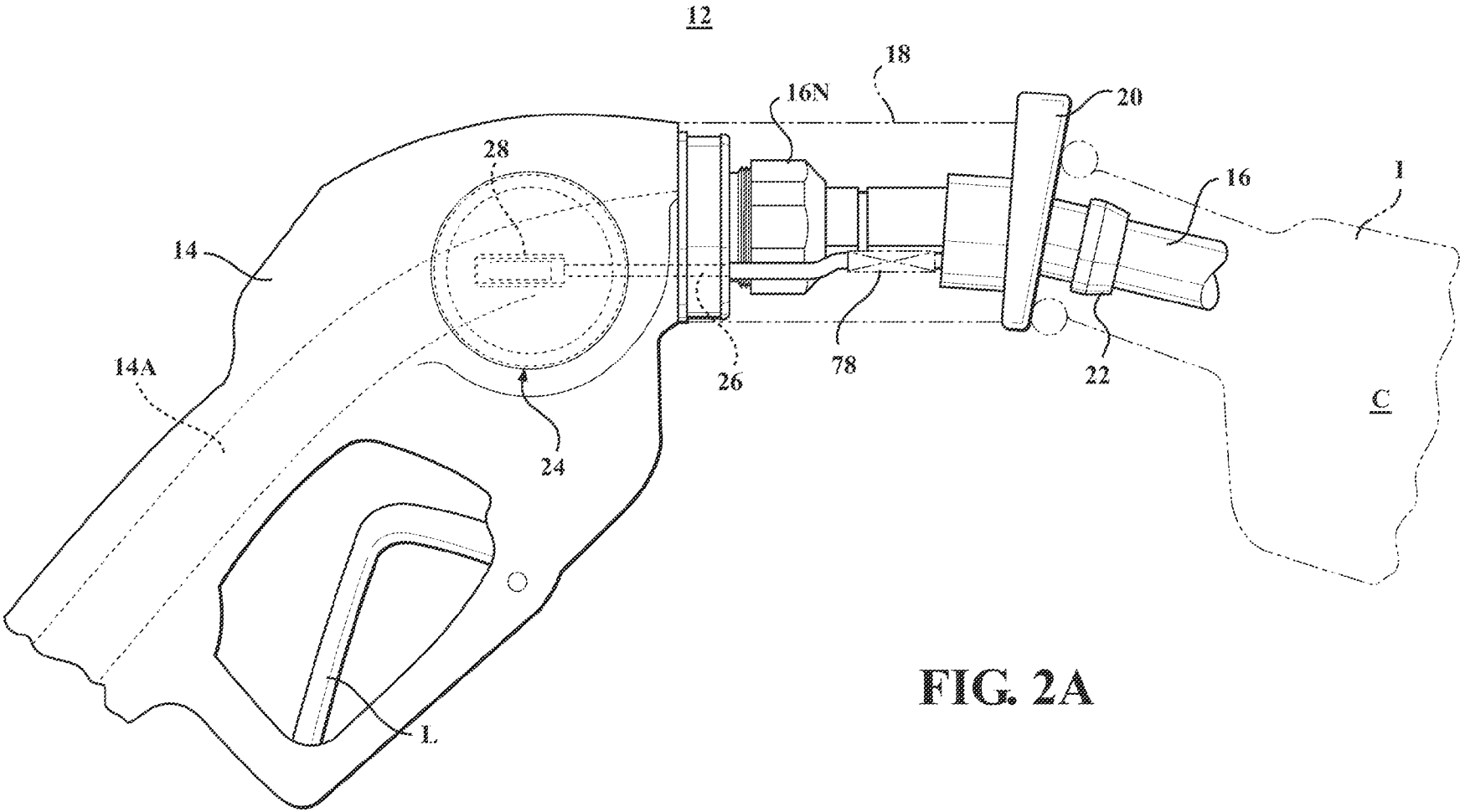
FIGS. 2A and 2B are partial schematic side views of nozzle assemblies illustrating further aspects of the teachings of the present application.
Figure 2B:
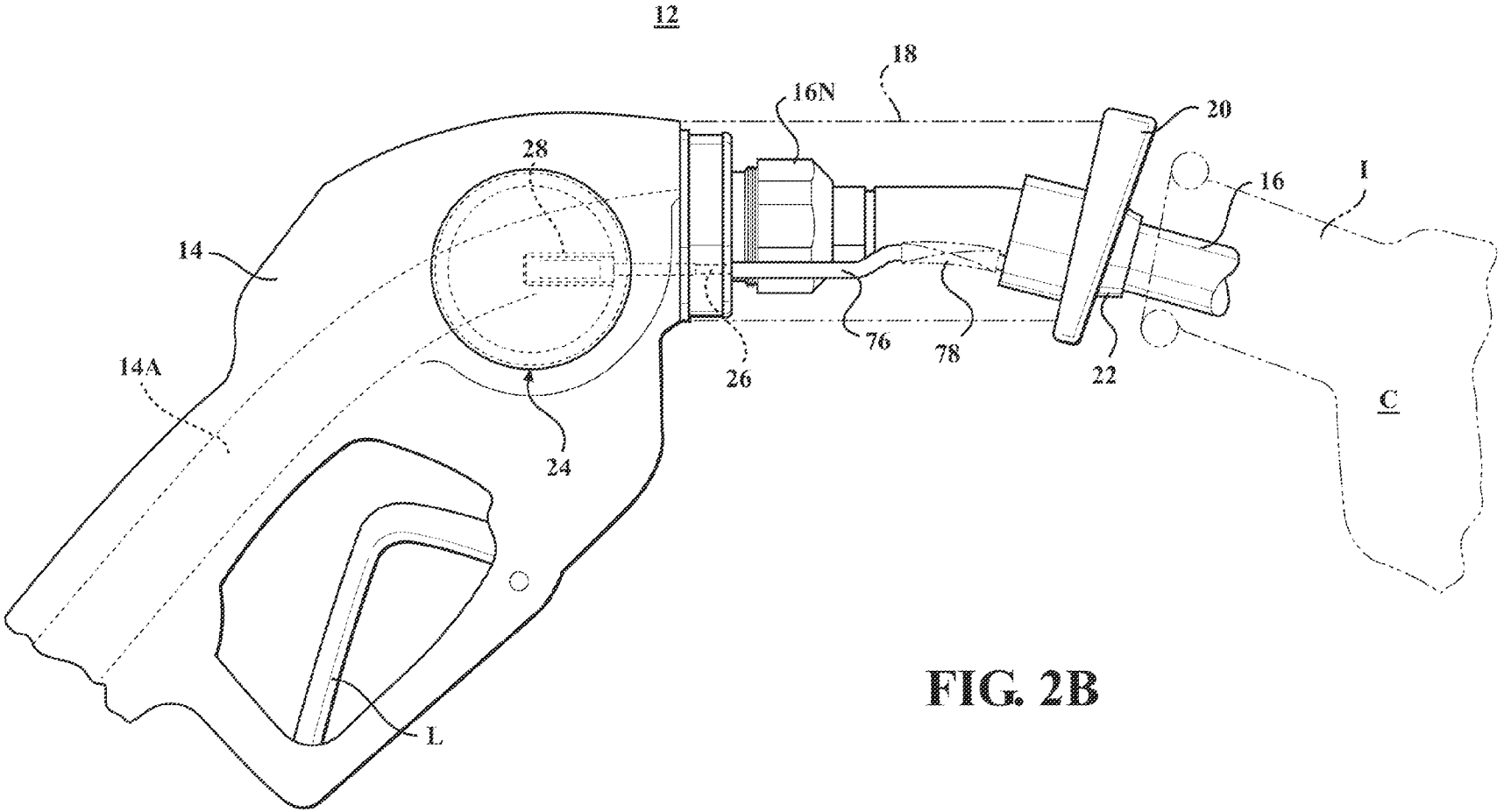
Figure 3B:
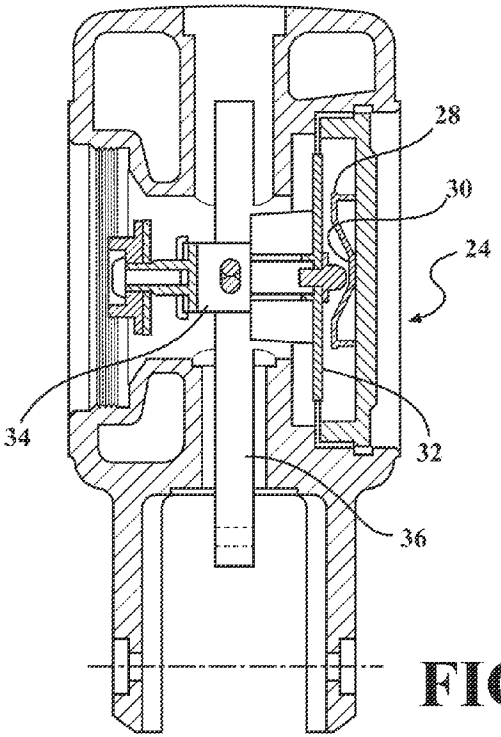
FIGS. 3A and 3B are cross sectional views of an interlock mechanism in engaged and disengaged positions, respectively.
Figure 3A:
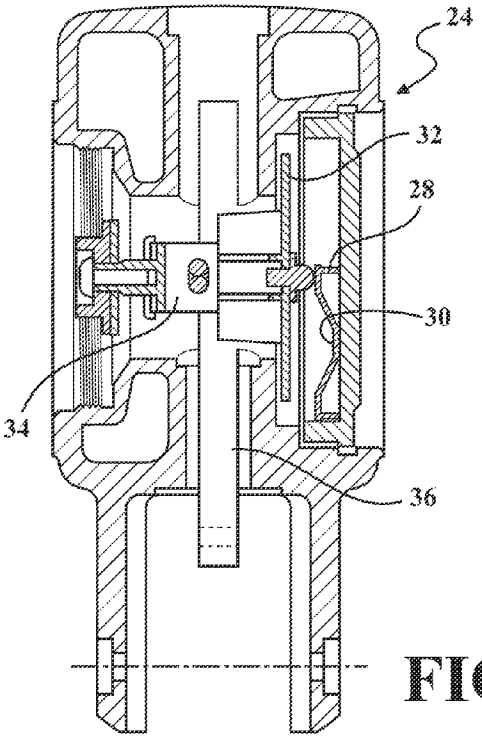

The nozzle assembly of FIGS. 2A and 2B includes an interlock rod 76 that is coupled to the sleeve 18 through the face seal 20 using a flexible actuator joint 78, illustrated as a coil spring, to accommodate nonlinear movement of the face seal 20 as the face seal 20 and the interlock rod 76 move along the spout 16. If the interlock rod 76 is formed as a rigid member with no lost motion mechanism as has been done in the prior art, the interlock mechanism may be moved beyond its disengaged position shown in FIG. 2A which may overextend the interlock mechanism and thereby increase the risk of premature failure of the interlock mechanism 24. To improve operation of the nozzle assembly of FIGS. 2A and 2B, for example by retrofitting existing nozzle assemblies, the interlock rod 76 can be modified to include the lost motion mechanism 48 shown in FIG. 5 described above.

Figure 6:
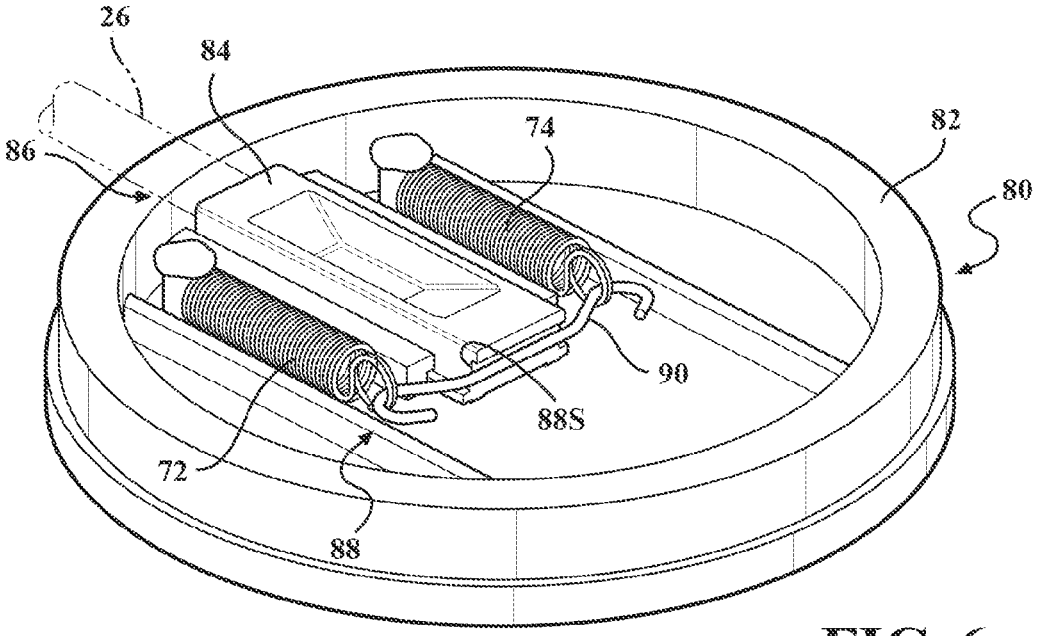
FIG. 6 PRIOR ART
FIG. 6 is a perspective view of an interlock mechanism according to the prior art.

Reference is now made to FIG. 6, which shows a prior art interlock mechanism 80 having an interlock assembly housing 82 and a slide 84 movable within the interlock assembly housing 82. The slide 84 has a first end 86 engaged by the interlock actuator 26 and a second end 88. First and second resilient members 72, 74, illustrated as expansion springs, are configured to bias the slide 84 into the interlock engaged position shown in FIGS. 1B and 2B. A spring hook 90 rests in a slot 88S of the second end 88 of the slide 84 and hooked ends engage the first and second resilient members 72, 74. Upon failure of one of the first and second resilient members 72, 74, the spring hook 90 tends to flip out of the slot 88S in the second end 88 of the slide 84. As a result, the slide 84 may no longer be biased into the interlock engaged position shown in FIGS. 1B and 2B. Accordingly, it is possible that the slide 84 may remain in the interlock disengaged position shown in FIGS. 1A and 2A whether the sleeve 18 is compressed or not. In this condition, the interlock mechanism no longer prevents operation of the nozzle assembly only when the sleeve 18 is at least partially compressed, for example by engagement of the face seal 20 with the inlet I of the container C.

Figure 7:
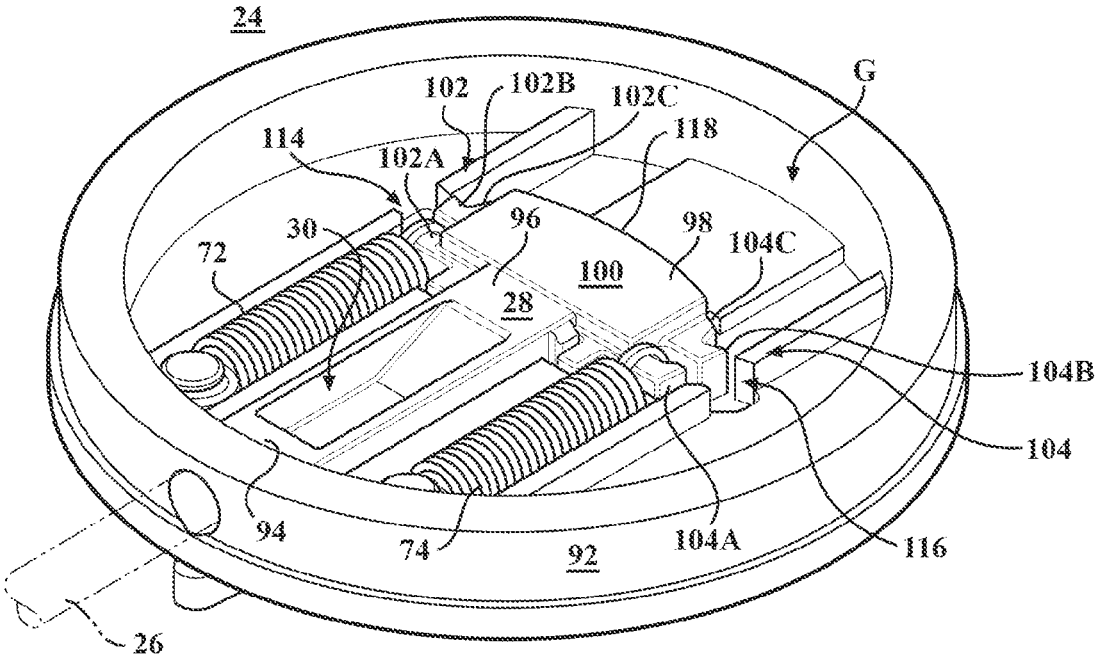
FIG. 7 is a perspective view of an embodiment of a failsafe interlock mechanism according to teachings of the present application.
Figure 7A:
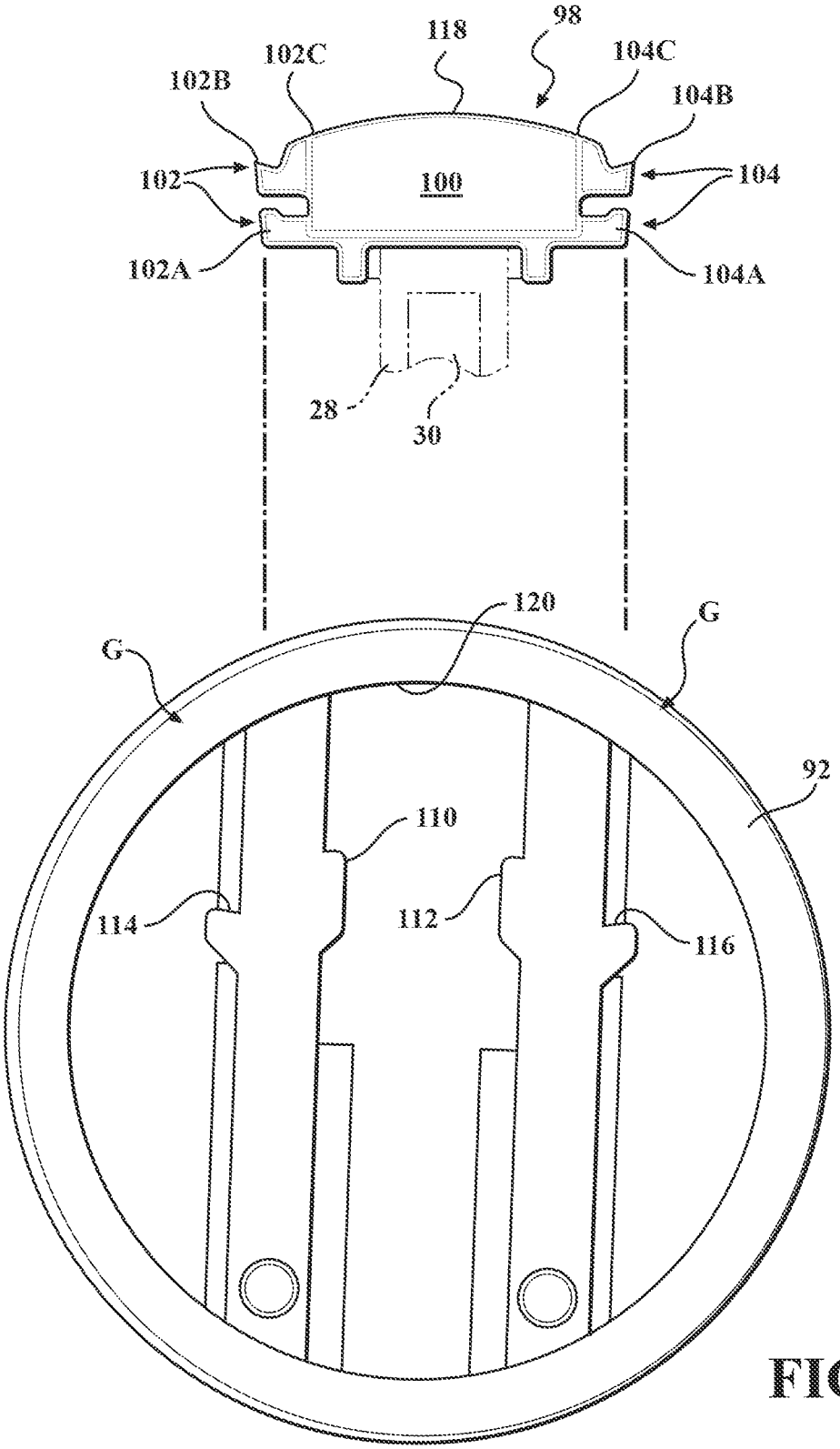
FIG. 7A illustrates structural detail of an interlock assembly housing and an end block used in the embodiment of FIG. 7.

Referring now to FIGS. 7 and 7A, an embodiment of the interlock mechanism 24 in accordance with the teachings of the present application comprises an interlock assembly housing 92 and a slide 28 movable within the interlock assembly housing 92. The slide 28 has a first end 94 engaged by the interlock actuator 26 and a second end 96. First and second resilient members 72, 74, extension springs as illustrated, are configured to bias the slide 28 into the interlock engaged position shown in FIGS. 1B, 2B and 7. A slide retaining member 98 is positioned to receive the second end 96 of the slide 28 and engage the first and second resilient members 72, 74. The slide retaining member 98 prevents movement of the slide 28 into the interlock disengaged position shown in FIGS. 1A and 2A in the event of failure of the interlock mechanism 24 as the result of one of the first and second resilient members 72, 74 breaking. Operation of the failsafe operation of the interlock mechanism of FIGS. 7 and 7A is shown in FIGS. 8A-F and is described below.

Referring to the embodiment of the interlock mechanism 24 of the present application shown in FIGS. 7 and 7A, the slide retaining member 98 comprises an end block 100 having first and second extensions 102, 104 on either side. The first and second extensions 102, 104 include first and second arms 102A and 104A that couple the block 100 to the first and second resilient members 72, 74 such that the slide 28 is disposed between the first and second resilient members 72, 74. Additionally, the first and second extensions 102, 104 include catches 102B, 102C, 104B and 104C that prevent movement of the slide 28 from the interlock engaged position to the interlock disengaged position in the event of failure of the interlock mechanism 24 due to breakage of one of the resilient members 72, 74. FIG. 7A more clearly shows structure of the interlock assembly housing 92 and the end block 100.

As shown in FIG. 7A, the interlock assembly housing 92 includes guide structure G along which the block 100 moves during normal operation of the interlock mechanism 24 as the slide 28 moves back and forth between the interlock engaged position and the interlock disengaged position. Inner openings 110, 112 and outer openings 114, 116 are formed in sidewalls of the guide structure G as shown. In the event of failure of one of the resilient members 72, 74, one of the catches 102B and 104B engages the corresponding one of the interlock housing outer openings 114, 116, while the opposite one of the catches 104C and 102C engages the corresponding one of the interlock housing inner openings 112, 110. While the engagement of one of the catches on either side of the block 100 prevents movement of the slide 28 into the interlock disengaged position in the event of failure of one of the first and second resilient members 72, 74, a double catch arrangement as shown in FIG. 8F is currently preferred for this embodiment to better ensure retention of the interlock mechanism in its engaged position.

Figure 8C:
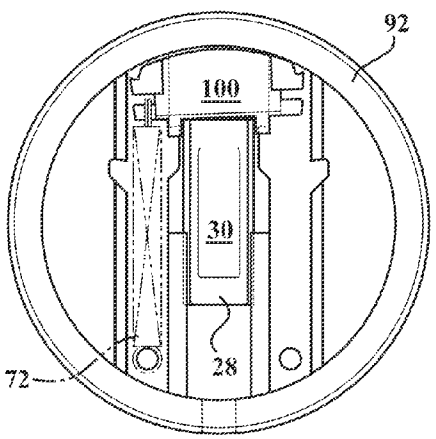
FIGS. 8A through 8F illustrate operation of the failsafe interlock mechanism of FIGS. 7 and 7A.
Figure 8F:
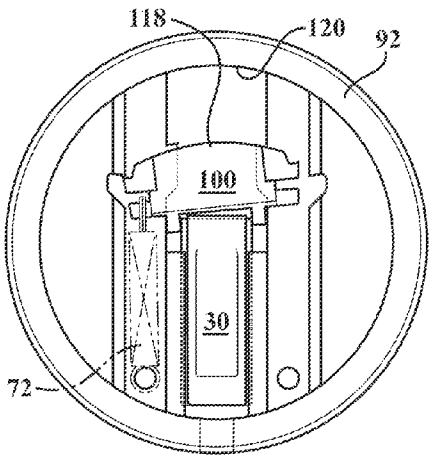
Figure 8B:
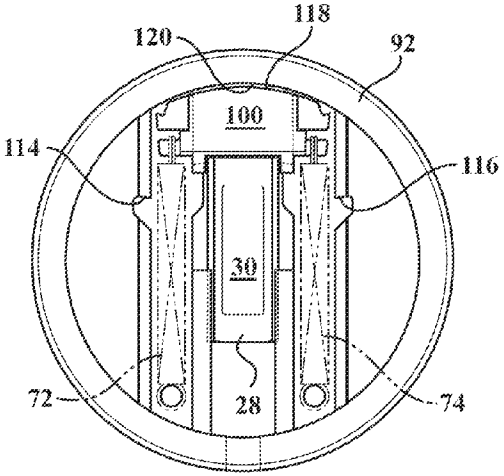
Figure 8E:
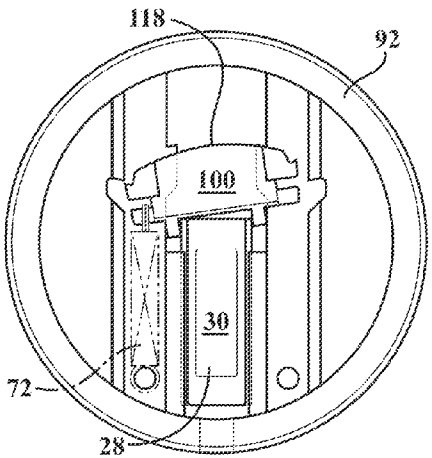
Figure 8A:
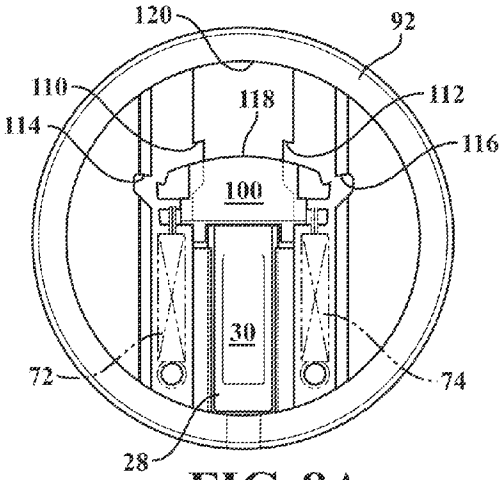
Figure 8D:
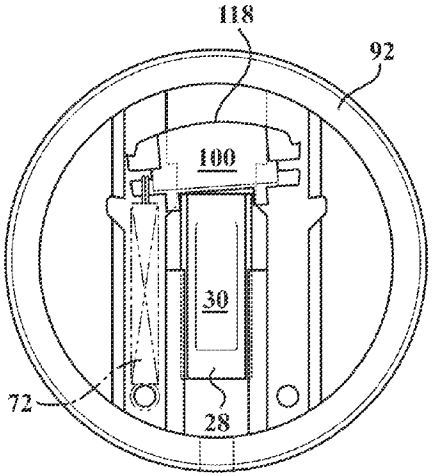
Figure 9A:
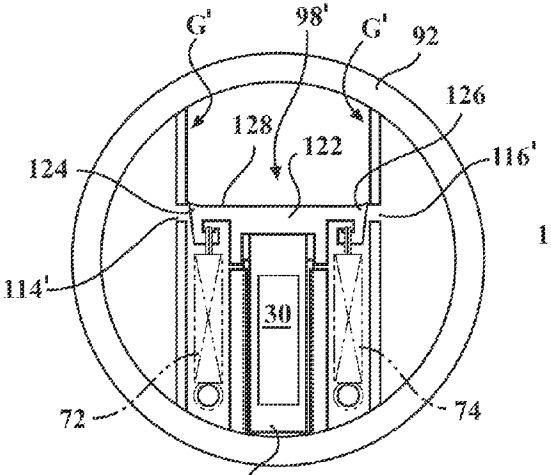
FIGS. 9A through 9F illustrate operation of another embodiment of a failsafe interlock mechanism according to the teachings of the present application.
Figure 9B:
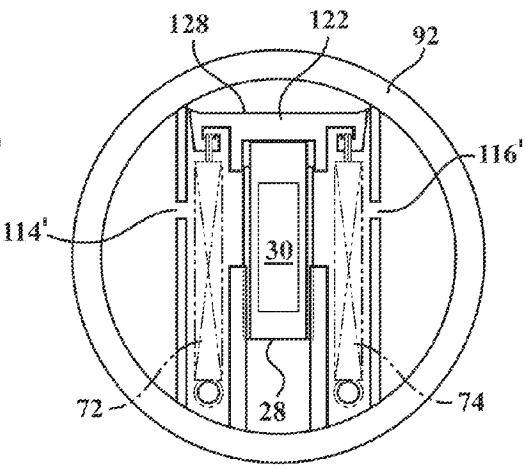
Figure 9C:
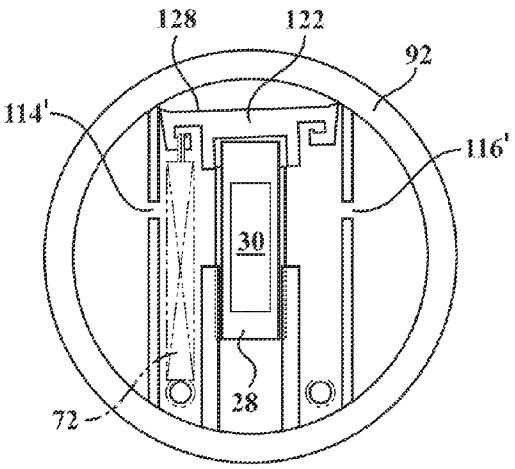
Figure 9D:
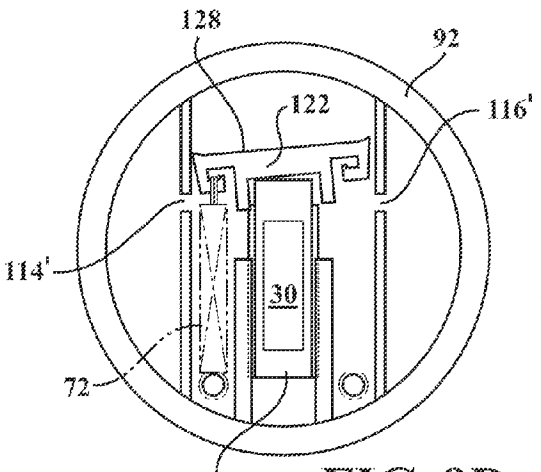
Figure 9E:
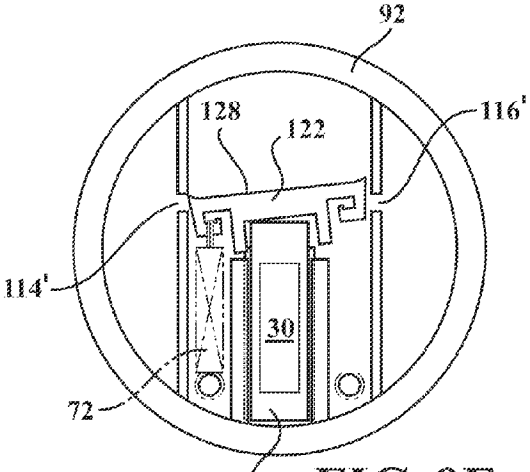
Figure 9F:
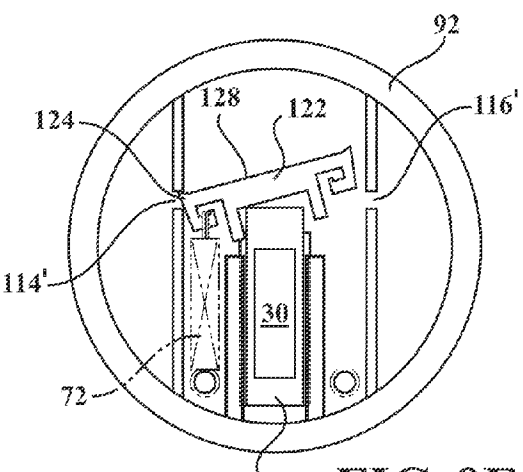

The end block 100 of the embodiment shown in FIGS. 7, 7A and 8A-8F comprises a curved side 118 distal from the slide 28 with the curved side 118 having a diameter substantially equal to the inner diameter 120 of the interlock assembly housing 92. FIG. 8A shows the interlock mechanism 24 in the engaged position, FIG. 8B shows the interlock mechanism 24 in the disengaged position and FIG. 8F shows the interlock mechanism 24 after the resilient member 74 has broken with the interlock mechanism 24 locked in its failsafe engaged position.

Reference is now made to FIG. 9, which shows another embodiment of the interlock mechanism 24 in accordance with the teachings of the present application. The embodiment of FIG. 9 includes a slide retaining member 98' that comprises an end block 122 having first and second end block extensions 124, 126 on either side. The first and second end block extensions 124, 126 are coupled to the first and second resilient members 72, 74 such that the slide 28 is disposed between the first and second resilient members 72, 74. The first and second end block extensions 124, 126 prevent movement of the slide 28 from the interlock engaged position shown in FIG. 9A to the interlock disengaged position shown in FIG. 9B in the event of failure of the interlock mechanism 24 due to breakage of one of the resilient members 72, 74. Upon such failure, one of the first and second end block extensions 124, 126 engages one of two openings 114', 116' in sidewalls of guide structure G' to prevent movement of the slide 28 from its interlock engaged position to its interlock disengaged position, see FIG. 9F where the end block extension 124 has engaged the opening 114' upon failure of the resilient member 74. As can be seen in FIGS. 9A-9F, the end block 122 comprises a substantially flat side 128 distal from the slide 28. The first and second end block extensions 124, 126 are disposed on and extend from the substantially flat side 128, as shown in FIGS. 9A-9F.

Figure 10:
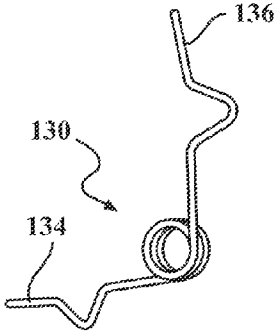
FIGS. 10 through 12 illustrate the structure and operation of yet another embodiment of a failsafe interlock mechanism according to the teachings of the present application.
Figure 12:
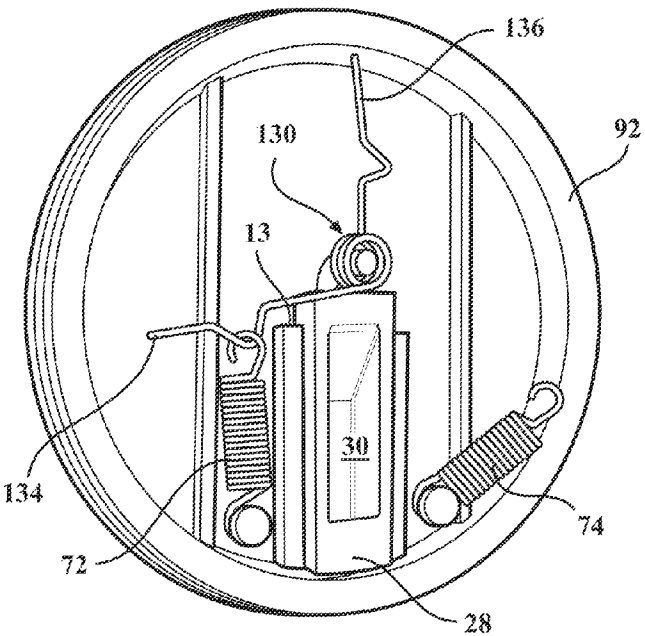
Figure 11:
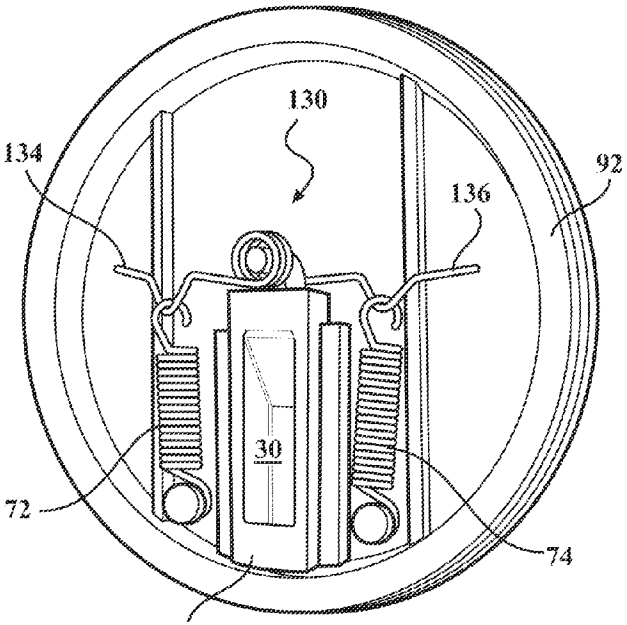

FIGS. 10-12 show yet another embodiment of an interlock mechanism in accordance with the teachings of the present application. A third resilient member 130, illustrated as a spring, has first and second arms 134, 136 which are biased away from a slide movement blocking position shown in FIG. 12 by the first and second resilient members 72, 74. The first and second arms 134, 136 engage the first and second resilient members 72, 74 as shown in FIG. 11. Upon failure of one of the first and second resilient members 72, 74 (illustrated in FIG. 12 by the spring 74 being disconnected from the notch in the arm 136), one of the first and second arms 134, 136 (the arm 136 as shown in FIG. 12) moves to a position that blocks movement of the slide 28 so that the interlock mechanism 24 cannot be placed into the interlock disengaged state.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A nozzle assembly for dispensing fuel into an inlet of a container comprising:

a body having a passage for fuel flow through said body;

a spout attachable to said body for passing fuel from said body, through said spout, and into an inlet of a container;

a sleeve fitted over said spout, said sleeve compressing when said spout is inserted into the inlet of the container and expanding from compression when said spout is removed from the inlet of the container;

an interlock mechanism within said body for preventing operation of said nozzle assembly unless said sleeve is at least partially compressed; and an interlock actuator mounted for movement within said body and coupled to said sleeve, said interlock mechanism moving from an engaged position to a disengaged position as said interlock actuator moves into said body upon compression of said sleeve and moving from said disengaged position to said engaged position as said interlock mechanism moves out of said body upon said sleeve expanding from compression wherein;

said interlock mechanism includes structure to prevent said interlock mechanism from moving from said engaged position to said disengaged position in the event of a failure of said interlock mechanism whereby said nozzle assembly cannot dispense fuel regardless of whether said spout is engaged with the inlet of the container or not.

2. The nozzle assembly as claimed in claim 1, wherein said interlock actuator comprises a lost motion mechanism to limit movement of said interlock actuator into said body.

3. The nozzle assembly as claimed in claim 2, wherein said interlock actuator comprises an interlock rod and said lost motion mechanism comprises at least one spring biasing said interlock rod.

4. The nozzle assembly as claimed in claim 3 wherein said interlock rod comprises:

a tubular member having a shouldered opening at a first end and a second end;

a shouldered push pin received within said tubular member and having a first end movably passing through said shouldered opening at said first end of said tubular member and a second end having a diameter larger than said first end and defining a shoulder that engages a shoulder of said shouldered opening of said tubular member to limit extension of said first end of said push pin from said tubular member; and at least one compression spring fitted within said tubular member and engaging said second end of said push pin; and a retainer secured into said second end of said tubular member for retaining said at least one compression spring between said retainer and said second end of said push pin.

5. The nozzle assembly as claimed in claim 2, wherein said interlock mechanism is biased to said engaged position by a first biasing force that increases to a second biasing force as said interlock mechanism moves to said disengaged position and said lost motion mechanism compresses said at least one compression spring at said second biasing force to limit movement of said interlock actuator into said body upon compression of said sleeve beyond a point of compression required to disengage said interlock mechanism.

6. The nozzle assembly as claimed in claim 5, wherein said interlock mechanism comprises:

at least one resilient member providing said first biasing force when said interlock mechanism is in said engaged position and providing said second biasing force when said interlock mechanism is in said disengaged position; and said lost motion mechanism comprises:

a first element movably coupled to said spout and supporting said interlock actuator;

a resilient actuator member positioned between said first element and said body;

a second element movably coupled to said spout and coupled to said sleeve; and a lost motion resilient member positioned between said first and second elements.

7. The nozzle assembly as claimed in claim 6 wherein said at least one resilient member comprises at least one extension spring, and said resilient actuator member and said lost motion resilient member each comprises at least one compression spring.

8. The nozzle assembly as claimed in claim 1, wherein said interlock mechanism comprises:

an interlock assembly housing;

a slide movable within said interlock assembly housing, said slide having a first end engaged by said interlock actuator and a second end;

first and second resilient members configured to bias said slide into said interlock engaged position; and a slide retaining member coupled to said second end of said slide and engaging said first and second resilient members, said slide retaining member preventing movement of said slide into said interlock disengaged position upon failure of one of said first and second resilient members.

9. The nozzle assembly as claimed in claim 8 wherein said slide retaining member comprises a third resilient member having first and second arms for engaging said first and second resilient members, one of said first and second arms moving to a position blocking movement of said slide within said interlock assembly housing upon failure of one of said first and second resilient members.

10. The nozzle assembly as claimed in claim 9 wherein said third resilient member comprises a spring including said first and second arms which are biased away from said slide movement blocking position by said first and second resilient members.

11. The nozzle assembly as claimed in claim 8 wherein said slide retaining member comprises an end block having first and second extensions on either side wherein said first and second extensions are coupled to said first and second resilient members such that said slide is disposed between said first and second resilient members, and said interlock assembly housing includes openings wherein one of said first and second end block extensions engages one of said interlock housing openings to prevent movement of said slide into said interlock disengaged position in the event of failure of one of said first and second resilient members.

12. The nozzle assembly as claimed in claim 11 wherein said end block comprises a substantially flat side distal from said slide, and said first and second end block extensions are disposed on and extend from said substantially flat side.

13. The nozzle assembly as claimed in claim 11 wherein said end block comprises a curved side distal from said slide, said curved side having a diameter substantially equal to an interlock assembly housing inner diameter, and said first and second end block extensions are disposed on and extend from said curved side.

14. A nozzle assembly for dispensing fuel into an inlet of a container comprising:

a body having a passage for fuel flow through said body;

a spout attachable to said body for passing fuel from said body, through said spout, and into an inlet of a container;

a sleeve fitted over said spout, said sleeve compressing when said spout is inserted into the inlet of the container and expanding from compression when said spout is removed from the inlet of the container;

an interlock mechanism within said body for preventing operation of said nozzle assembly unless said sleeve is at least partially compressed; and an interlock actuator mounted for movement within said body and coupled to said sleeve, said interlock mechanism moving from an engaged position to a disengaged position as said interlock actuator moves into said body upon compression of said sleeve and moving from said disengaged position to said engaged position as said interlock mechanism moves out of said body upon said sleeve expanding from compression wherein said interlock actuator comprises a lost motion mechanism to limit movement of said interlock actuator into said body.

15. The nozzle assembly as claimed in claim 14, wherein said interlock actuator comprises an interlock rod and said lost motion mechanism comprises at least one spring biasing said interlock rod.

16. The nozzle assembly as claimed in claim 15 wherein said interlock rod comprises:

a tubular member having a shouldered opening at a first end and a second end;

a shouldered push pin received within said tubular body having a first end movably passing through said opening at said shouldered end of said tubular body and a second end having a diameter larger than said first end and defining a shoulder that engages a shoulder of said shouldered opening of said tubular member to limit extension of said first end of said push pin from said tubular member; and at least one compression spring fitted within said tubular member and engaging said second end of said push pin; and a retainer secured into said second end of said tubular member for retaining said at least one compression spring between said retainer and said second end of said push pin.

17. The nozzle assembly as claimed in claim 14, wherein said interlock mechanism is biased to said engaged position by a first biasing force that increases to a second biasing force as said interlock mechanism moves to said disengaged position and said lost motion mechanism compresses at said second biasing force to limit movement of said interlock actuator into said body upon compression of said sleeve beyond a point of compression required to disengage said interlock mechanism.

18. The nozzle assembly as claimed in claim 17, wherein said interlock mechanism comprises:

at least one resilient member providing said first biasing force when said interlock mechanism is in said engaged position and providing said second biasing force when said interlock mechanism is in said disengaged position; and said lost motion mechanism comprises:

a first element movably coupled to said spout and supporting said interlock actuator;

a resilient actuator member mounted between said first element and said body;

a second element movably coupled to said spout and coupled to said sleeve; and a lost motion resilient member positioned between said first and second elements.

19. The nozzle assembly as claimed in claim 18 wherein said at least one resilient member comprises at least one extension spring, and said resilient actuator member and said lost motion resilient member each comprises at least one compression spring.

20. The nozzle assembly as claimed in claim 14, wherein said interlock mechanism is biased to said engaged position by a first biasing force that increases to a second biasing force as said interlock mechanism moves to said disengaged position, and said lost motion mechanism compresses substantially at said second biasing force to limit movement of said interlock actuator into said body upon compression of said sleeve beyond a point of compression required to disengage said interlock mechanism.

21. The nozzle assembly as claimed in claim 20, wherein said interlock mechanism comprises:

at least one resilient member providing said first biasing force when said interlock mechanism is in said engaged position and providing said second biasing force when said interlock mechanism is in said disengaged position; and said lost motion mechanism comprises:

a first element movably coupled to said spout and supporting said interlock actuator;

a resilient actuator member positioned between said first element and said body;

a second element movably coupled to said spout and coupled to said sleeve; and a lost motion resilient member positioned between said first and second elements.

22. The nozzle assembly as claimed in claim 21, wherein said at least one resilient member comprises at least one extension spring, and said resilient actuator member and said lost motion resilient member each comprises at least one compression spring.

23. The nozzle assembly as claimed in claim 14, wherein said interlock mechanism includes structure to prevent movement of said interlock mechanism from said engaged position to said disengaged position in the event of a failure of said interlock mechanism whereby said nozzle assembly cannot dispense fuel regardless of whether said spout is engaged with the inlet of the container or not.

24. The nozzle assembly as claimed in claim 23 wherein said interlock mechanism comprises:

an interlock assembly housing;

a slide movable within said interlock assembly housing, said slide having a first end engaged by said interlock actuator and a second end;

first and second resilient members configured to bias said slide into said interlock engaged position; and a slide retaining member coupled to said second end of said slide and engaging said first and second resilient members, said slide retaining member preventing movement of said slide into said interlock disengaged position upon failure of one of said first and second resilient members.

25. The nozzle assembly as claimed in claim 24, wherein said slide retaining member comprises a third resilient member having first and second arms for engaging said first and second resilient members, one of said first and second arms moving to a position blocking movement of said slide within said interlock assembly housing upon failure of one of said first and second resilient members.

26. The nozzle assembly as claimed in claim 25 wherein said third resilient member comprises a spring including said first and second arms which are biased away from said slide movement blocking position by said first and second resilient members.

27. The nozzle assembly as claimed in claim 25, wherein said slide retaining member comprises an end block having first and second extensions on either side, said first and second extensions are coupled to said first and second resilient members such that said slide is disposed between said first and second resilient members, said interlock assembly housing includes openings and one of said first and second end block extensions engages one of said interlock housing openings to prevent movement of said slide into said interlock disengaged position in the event of failure of one of said first and second resilient members, and said end block comprises one of a substantially flat side and a curved side distal from said slide wherein said first and second end block extensions are disposed on and extend from said one of a substantially flat side and curved side.

28. The nozzle assembly as claimed in claim 1, wherein said sleeve is for vapor collection from said container.

29. The nozzle assembly as claimed in claim 14, wherein said sleeve is for vapor collection from said container.

* * * * *